US007532166B2

(12) United States Patent
Kim et al.

(10) Patent No.: US 7,532,166 B2
(45) Date of Patent: May 12, 2009

(54) ANTENNA DEVICE FOR PORTABLE TERMINAL

(75) Inventors: Dong-Hwan Kim, Hwaseong-si (KR); Jinu Kim, Seoul (KR); Wan-Jin Choi, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 7 days.

(21) Appl. No.: 11/250,289

(22) Filed: Oct. 14, 2005

(65) Prior Publication Data

US 2006/0097931 A1 May 11, 2006

(30) Foreign Application Priority Data

Oct. 26, 2004 (KR) ..... 10-2004-0085874

(51) Int. Cl.
*H01Q 1/24* (2006.01)

(52) U.S. Cl. ..... 343/702; 343/906

(58) Field of Classification Search ..... 343/702, 343/906; 455/575.7

See application file for complete search history.

(56) References Cited

U.S. PATENT DOCUMENTS

| | | | | |
|---|---|---|---|---|
| 4,490,727 | A | 12/1984 | Kowols | 343/895 |
| 5,918,163 | A * | 6/1999 | Rossi | 455/558 |
| 5,990,848 | A * | 11/1999 | Annamaa et al. | 343/895 |
| 6,266,017 | B1 * | 7/2001 | Aldous | 343/702 |

FOREIGN PATENT DOCUMENTS

| | | |
|---|---|---|
| CN | 1190805 | 8/1998 |
| JP | 2004-253924 | 9/2004 |

* cited by examiner

*Primary Examiner*—Michael C Wimer
(74) *Attorney, Agent, or Firm*—The Farrell Law Firm, PC

(57) ABSTRACT

Provided is an antenna device for a portable terminal including a first housing and a second housing assembled with the first housing so as to slidingly move on the first housing. The antenna device includes an antenna pattern installed on an inner surface of the second housing; and at least one connecting terminal, which is installed on the outer surface of the first housing and is sliding by connected to the antenna pattern, wherein the second housing is assembled with the first housing to at least partially cover the first housing. The antenna device has few parts and has a simple structure, thus simplifying manufacture and reducing.

10 Claims, 8 Drawing Sheets

ANTENNA DEVICE FOR PORTABLE TERMINAL

PRIORITY

This application claims priority under 35 U.S.C. § 119 to an application entitled "Antenna Device for Portable Terminal" filed in the Korean Intellectual Property Office on Oct. 26, 2004 and assigned Serial No. 2004-85874, the contents of which are incorporated herein by reference.

BACKGROUND OF THE INVENTION

1. Field of the Invention

The present invention relates generally to portable terminals including digital communication devices such as cellular phones, personal digital assistants (PDAs), hand held phones (HHPs), camera phones, game phones, and Internet phones, and in particular, to an antenna device for a portable terminal, of which transmission/reception sensitivity is adjusted according to sliding movement on the portable terminal.

2. Description of the Related Art

The term portable terminal commonly refers to an electronic device with which a user can perform wireless communications. The design trend of portable terminals is geared towards portability and thus miniaturization light-weight designs. Moreover, multimedia compatibility is also desirable. Portable terminals are thus evolving into small, light-weight multi-function communication terminals which can also be adapted to various multimedia or Internet environments. Also, as portable terminals have become more prevalent they have transformed from being luxuries to being necessities throughout the world.

Conventional portable terminals are classified into several types by appearance. For example, according to the appearances of portable terminals, the conventional portable terminals are classified into bar type, flip type, and folder type terminals. The term bar-type terminal typically refers to a terminal in which a single housing is configured in a bar type manner, the term flip type terminal typically refers to a terminal in which a flip is rotatably assembled with a bar type housing by a hinge apparatus, and the term folder-type terminal typically refers to terminals in which a folder is rotatably assembled with a single bar type housing using a hinge apparatus so that the folder can be folded over the housing.

Also, according to wearing positions or methods, the portable terminals may be classified into neck-wearable type and wrist type terminals. The neck-wearable type terminal typically refers to a portable terminal which a user can wear around the user's neck using a string, and the wrist type terminal typically refers to a portable terminal which a user can wear around the user's wrist.

Also, according to the methods used to open/close the portable terminals, the portable terminals can be classified into rotation type and sliding type terminals. The rotation type terminal means a terminal in which two housings are rotatably assembled and open/closed while facing each other, and the sliding type terminal means a terminal in which two housings are open/closed by sliding movement in a longitudinal direction. Those skilled in the art will easily understand the variously classified portable terminals described above.

Conventional portable terminals thus are developing into advanced portable terminals which are capable of enabling high-speed data communication and/or voice communication functions. That is, in order to meet the increasing customer's demands, future portable terminals will provide services using a wireless communication technology for transmitting data at a high data rate.

Recently, conventional portable terminals have begun to adopt (internally and/or externally located) cameras, thus popularizing the transmission of digital images (e.g., photographs, graphics, icons, etc.).

However, antenna devices adopted by the conventional portable terminals have the following disadvantages. In a case where the conventional portable terminal adopts a retractable antenna comprised of a helical antenna and a rod antenna as an antenna device, its user must inconveniently pull out the retracted rod antenna to increase reception sensitivity when the reception sensitivity decreases, and retract the pulled-out rod antenna after a call. When the portable terminal is carried in a pocket, its portability is decreased due to protrusion of the antenna device. Moreover, when a portable terminal with an external antenna drops, the external antenna is more likely to be damaged.

Furthermore, in a case where a portable terminal incorporating a fixed built-in type antenna device, when antenna's reception sensitivity decreases due to geographical features, there is no way to cope with the decrease in reception sensitivity.

SUMMARY OF THE INVENTION

An object of the present invention is to substantially solve at least the above problems and/or disadvantages and to provide at least the advantages below. Accordingly, an object of the present invention is to provide an antenna device for a portable terminal, which is built in the portable terminal and can be popped in or out according to reception sensitivity.

Another object of the present invention is to provide an antenna device for a portable terminal, configured such that the antenna device can be slidingly located relative to the portable terminal, thereby adjusting reception sensitivity.

According to one aspect of the present invention, an antenna device for a portable terminal including a first housing and a second housing assembled with the first housing so as to slidingly move on the first housing including an antenna pattern installed on an inner surface of the second housing; and at least one connecting terminal, which is installed on the outer surface of the first housing and connected to the antenna pattern, wherein the second housing is assembled with the first housing to cover the first housing.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

Figure 1:
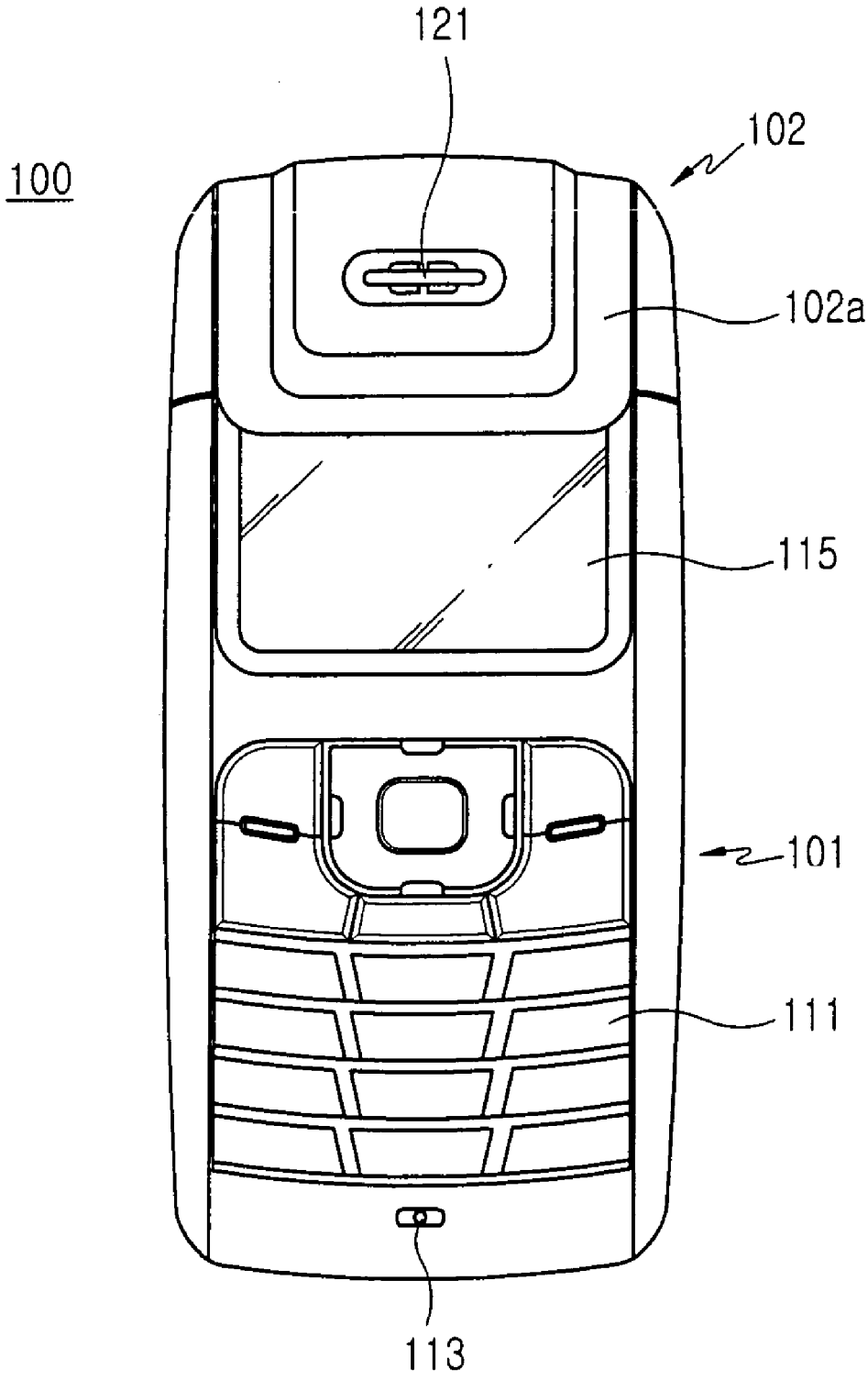
FIG. 1 is a front view illustration of a portable terminal including an antenna device according to a preferred embodiment of the present invention.

A preferred embodiment of the present invention will be described hereinbelow with reference to the accompanying drawings. In the drawings, the same or similar elements are denoted by the same reference numerals even though they are depicted in different drawings. In the following description, well-known functions or constructions are not described in detail since they would obscure the invention in unnecessary detail.

Figure 2:
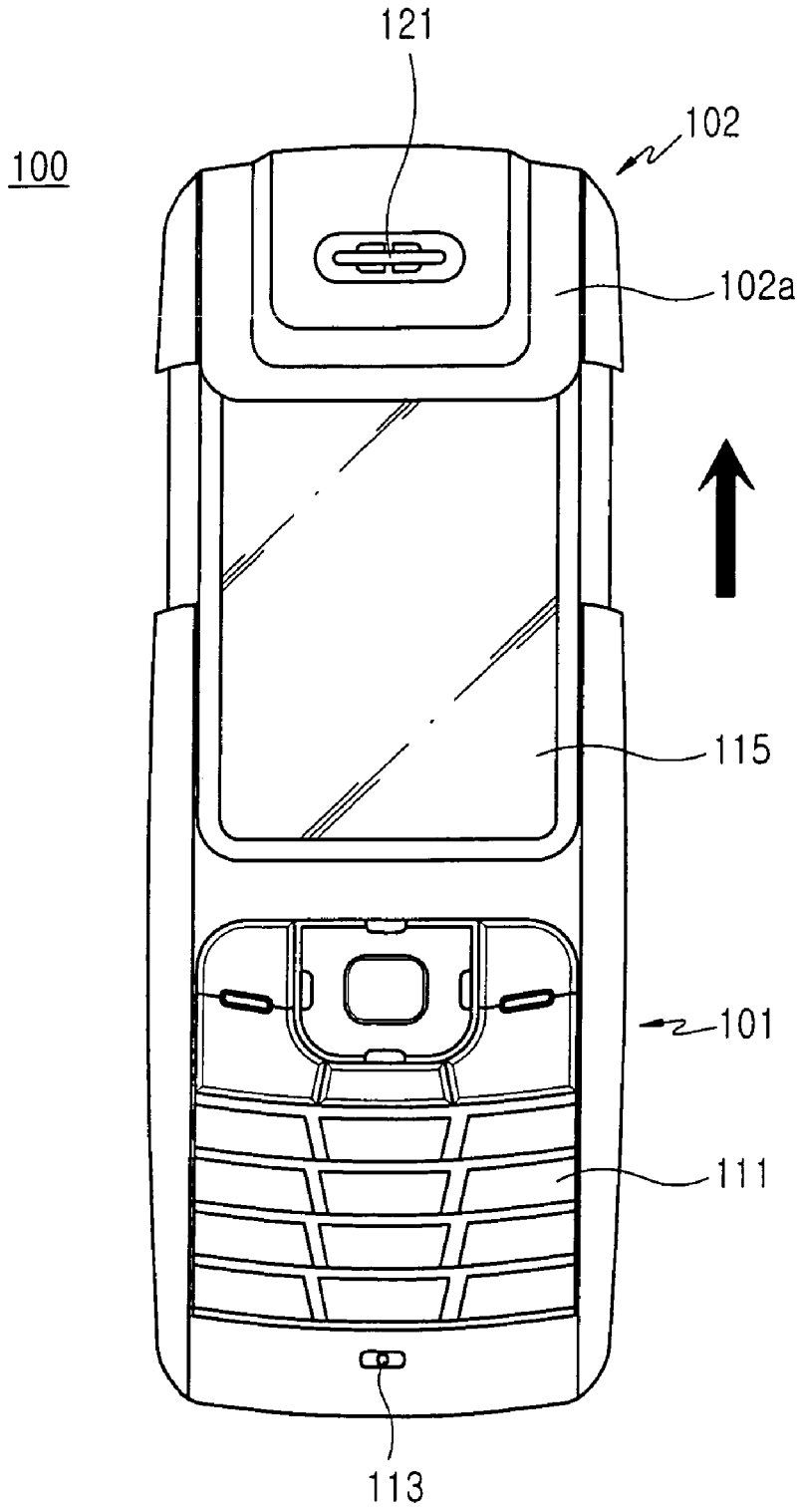
FIG. 2 is a front view illustration of the portable terminal of FIG. 1 with the second housing slidingly located in an extended position relative to the first housing.
Figure 3:
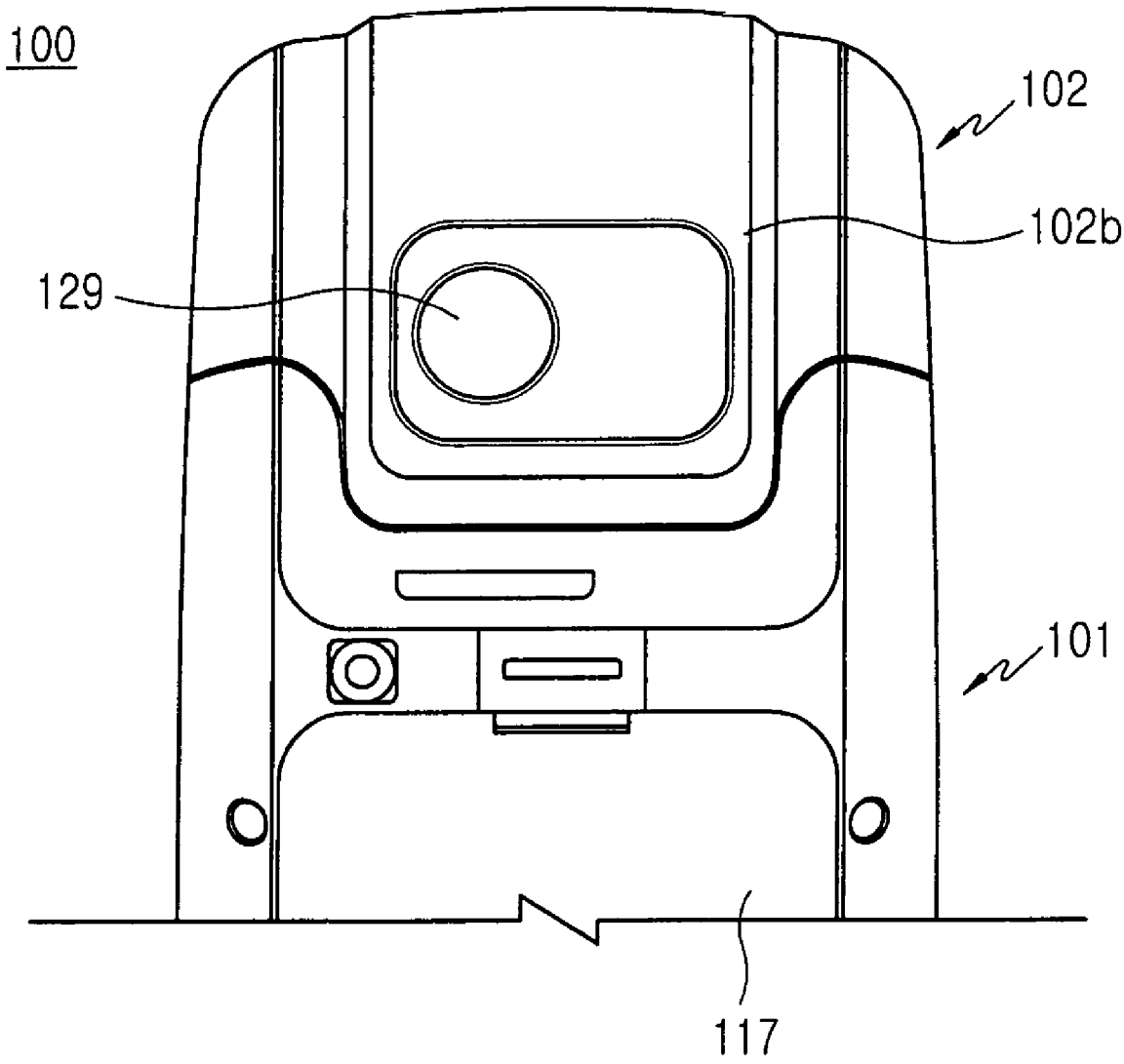
FIG. 3 is a rear view illustration of the portable terminal shown in FIG. 1.
Figure 4:
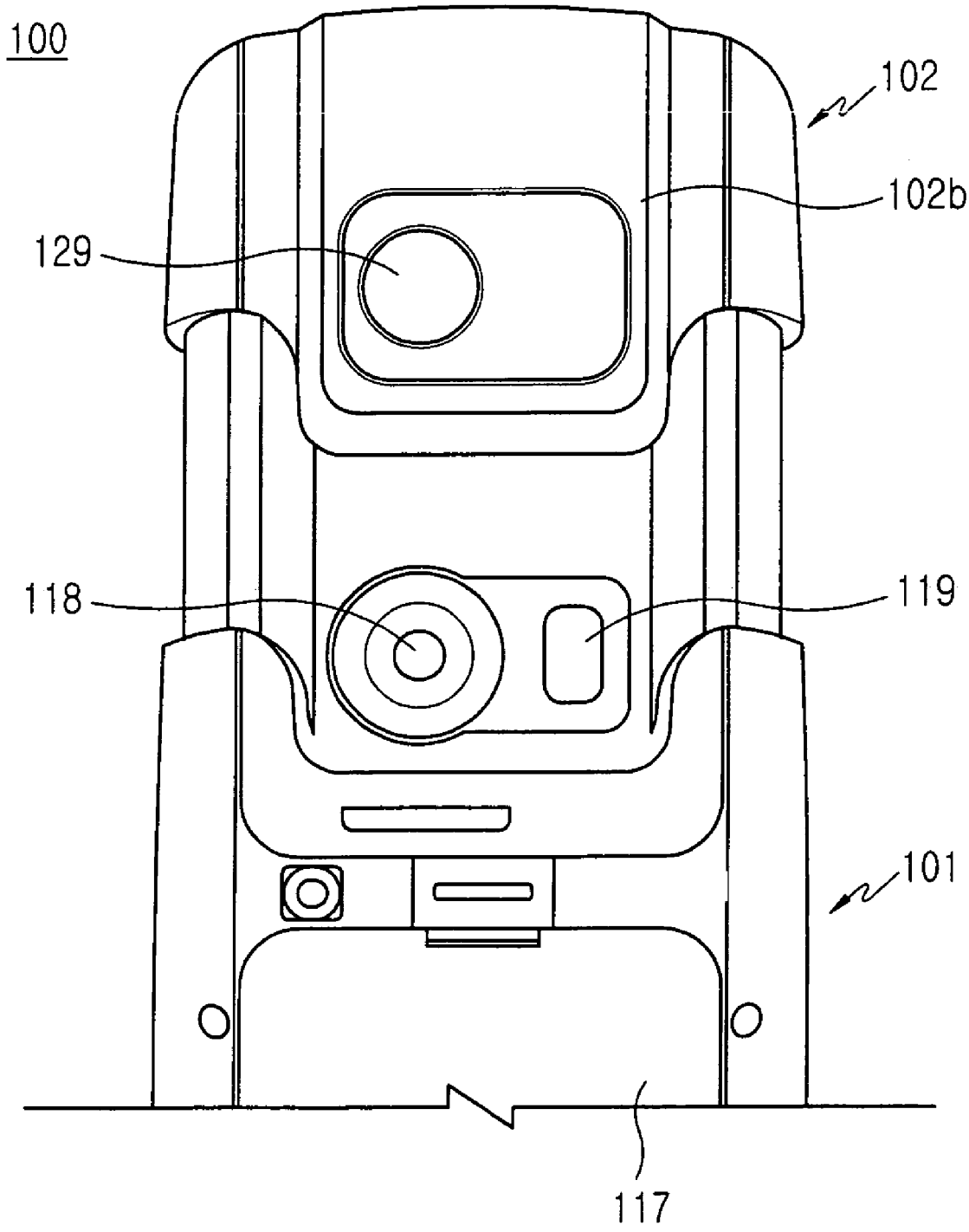
FIG. 4 is a rear view illustration of the portable terminal shown in FIG. 2.

FIG. 1 is a front view illustration of a portable terminal 100 including an antenna device according to a preferred embodiment of the present invention, FIG. 2 is a front view illustrating a state after a second housing 102 of the portable terminal 100 shown in FIG. 1 is slidingly moved, and FIGS. 3 and 4 are rear views of the portable terminal 100 shown in FIGS. 1 and 2, respectively.

Figure 5:
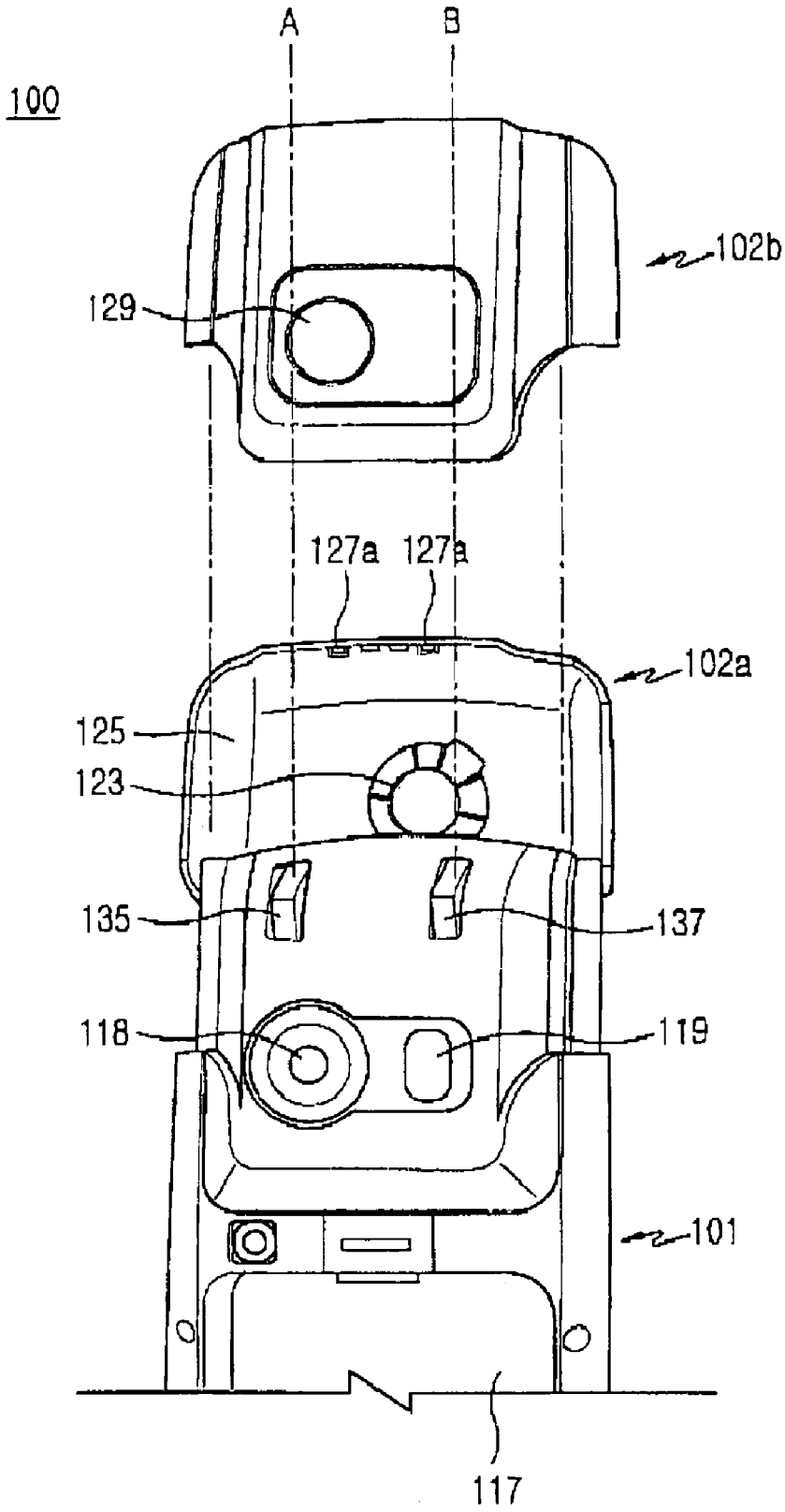
FIG. 5 is a rear view illustration showing a state in which a rear cover of the second housing of the portable terminal shown in FIG. 4 is disassembled.
Figure 6:
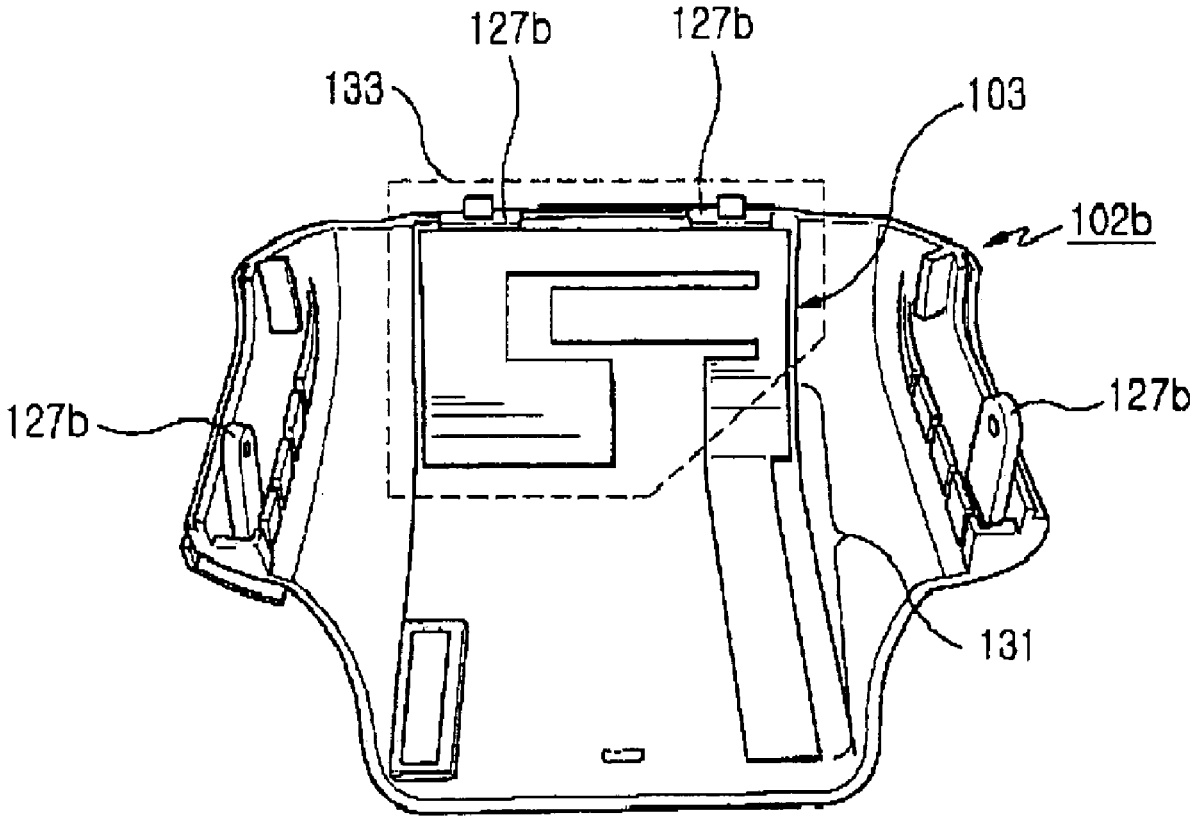
FIG. 6 is a perspective view illustration of the inside of the rear cover of the second housing shown in FIG. 5.

As shown in FIGS. 1 through 4, the portable terminal 100 includes a bar shaped first housing 101, in the front of which a keypad 111, a mouthpiece 113, and a display unit 115 are installed, and the second housing 102, which is assembled with the first housing 101 to slidingly move on a top portion of the first housing 101 and opens/closes a portion of the display unit 115. The second housing 102 is assembled with the first housing 101 to slidingly move in a longitudinal direction relative to the first housing 101. The second housing 102 includes a front cover 102*a* and a rear cover 102*b*, and is configured to cover the top portion of the first housing 101. An earpiece 121 is installed in the front cover 102*a* of the second housing 102. A speaker 123 (refer to FIG. 5) is installed on an inner surface 125 of the front cover 102*a* in which the earpiece 121 is installed, and the front cover 102*a* and the rear cover 102*b* are assembled using a plurality of latching pieces 127*a* and 127*b* (which are shown in FIGS. 5 and 6) formed thereon, respectively.

When the second housing 102 is located such that it covers the first housing 101 and a portion of the display unit 115, the portable terminal 100 is in a idle mode. When a user wishes to change an operation mode of the portable terminal 100 to a call mode, the user can manipulate the keypad 111 (e.g., by depressing a key) or slidingly move the second housing 102.

Referring to FIGS. 3 and 4, a containing recess 117 for installing a battery pack (not shown) is formed in a rear surface of the first housing 101, and a camera device 118 is located in an upper location from the containing recess 117. A flash unit 119 is installed on the side of the camera device 118, and the flash unit 119 and the camera device 118 are open/closed according to movement of the second housing 102 sliding on the first housing 101.

An optional mirror 129 is installed on a rear surface of the second housing 102. When the user wishes to photograph himself/herself using the camera device 118, the user can preview an image of himself/herself using the mirror 129 before capturing a digital image.

Figure 7:
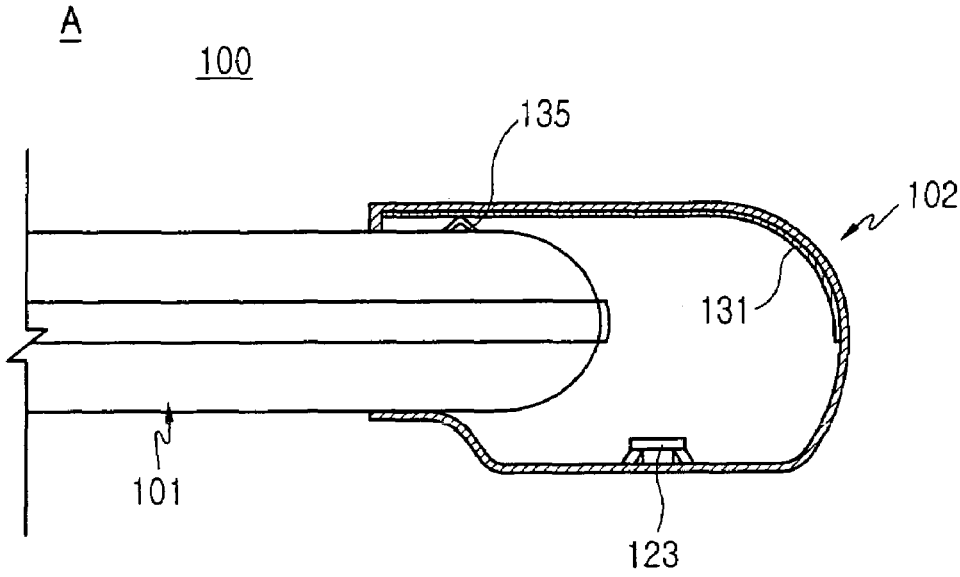
FIGS. 7 and 8 are cross-sectional view illustrations of the second housing further illustrating a configuration of the antenna device for the portable terminal shown in FIG. 1 respectively taken along lines A-A and B-B of FIG. 5.
Figure 8:
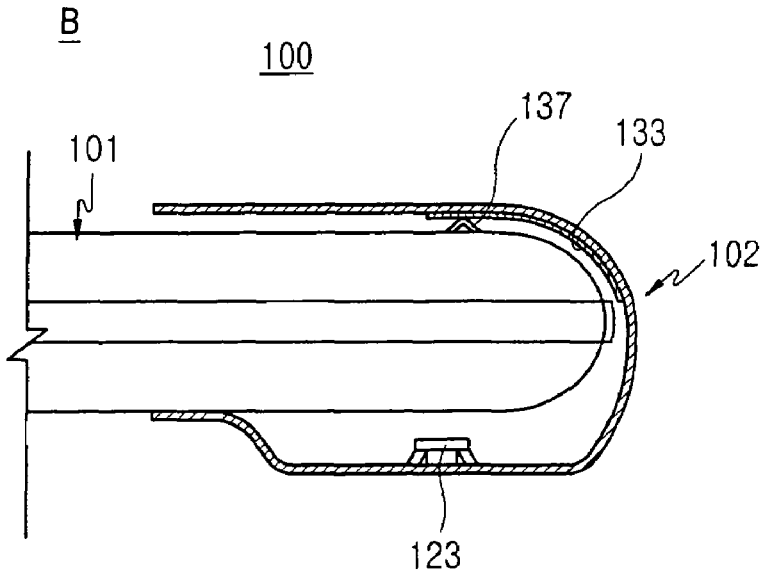

FIG. 5 is a rear view illustration showing a state in which the rear cover 102*b* of the second housing 102 of the portable terminal 100 shown in FIG. 4 is disassembled, FIG. 6 is a perspective view illustration of the inside of the rear cover 102*b* of the second housing 102 shown in FIG. 5. FIGS. 7 and 8 are cross-sectional view illustrations of the second housing further illustrating a configuration of the antenna device for the portable terminal 100 shown in FIG. 1 respectively taken along lines A-A and B-B of FIG. 5.

As shown in FIGS. 5 through 8, the antenna device for the portable terminal 100 includes an antenna pattern 103 installed on an inner surface of the rear cover 102*b* of the second housing 102 and at least one of connecting terminals 135 and 137 for connecting the antenna pattern 103 with circuits (e.g., the portable terminal's internal circuitry, etc.) (not shown) of the portable terminal 100.

The antenna pattern 103 is installed on the inner surface of the rear cover 102*b* of the second housing 102 and includes a connecting portion 131, which is extended in a direction parallel to a sliding movement of the second housing 102 relative to the first housing 101, and a radiating portion 133, which is configured in an edge portion of the connecting portion 131. The connecting portion 131 is extended along the sliding movement of the second housing 102, and even if the second housing 102 slidingly moves, a state where a portion of the connecting portion 131 faces the rear surface of the first housing 101 is maintained. In contrast, the radiating portion 133 is located at a top portion of the second housing 102. Therefore, in a state where the second housing 102 overlaps with the first housing 101, the radiating portion 133 maintains a state of facing the rear surface of the first housing 101. However, in a state where the second housing 102 is slidingly moved upward, the radiating portion 133 is spaced apart from the first housing 101.

The antenna pattern 103 may be printed on the inner surface of the second housing 102 such as like a printed circuit pattern formed on a substrate or configured as an antenna plate attached to the inner surface of the second housing 102 after being constructed in a predetermined pattern by sheet metal working. Here, the antenna pattern 103 should be shaped and sized such that it is suitable for a transmission/reception frequency band of the portable terminal 100. In the present embodiment, the antenna pattern 103 is an antenna plate in which a pattern shape is constructed by sheet metal working.

The connecting terminals 135 and 137 are installed on the rear surface of the first housing 101. At least one of the connecting terminals 135 and 137 is a power feeding terminal 135 connecting the antenna pattern 103 with a circuit device of the portable terminal 100, to be specific, transmission/reception circuit devices (not shown) of the portable terminal 100. Also, as illustrated in this embodiment, the other of the connecting terminals 135 and 137 is a ground terminal 137 connecting the antenna pattern 103 with the ground of the circuit device of the portable terminal 100.

The power feeding terminal 135 includes a plate spring maintaining a state of protruding from the rear surface of the first housing 101 and installed within a range in which the connecting portion 131 passes according to the sliding movement of the second housing 102 relative to the first housing 101. Therefore, regardless of whether the second housing 102 slidingly moves, the power feeding terminal 135 always maintains a state of being connected with the antenna pattern 103 within a range of the sliding movement of the second housing 102. Also, since the power feeding terminal 135 is made of a plate spring and protrudes from the outer surface of the first housing 101, when the second housing 102 slidingly moves, the power feeding terminal 135 slidingly contacts the connecting portion 131 of the antenna pattern 103.

The ground terminal 137 protrudes from the outer surface of the first housing 101, located in parallel to the power feeding terminal 135, and is made of a plate spring like the power feeding terminal 135. Here, preferably, the ground terminal 137 is properly spaced apart from the power feeding terminal 135 so that it does not interfere with the connecting portion 131. The ground terminal 137 selectively contacts the antenna pattern 103 according to the sliding movement of the second housing 102. That is, in the state where the second housing 102 overlaps with the first housing 101, the ground terminal 137 contacts the radiating portion 133 of the antenna pattern 103, and in the state where the second housing 102 is slidingly moved upward from the first housing 101, the ground terminal 137 is located apart from the first housing 101.

When the second housing 102 overlaps with the first housing 101, the connecting portion 131 and the radiating portion 133 contact the power feeding terminal 135 and the ground terminal 137, respectively. Here, the antenna pattern 103 operates as a flat plate type inverted-F antenna or a loop antenna.

When the second housing 102 is slidingly moved upward from the first housing 101, the radiating portion 133 does not contact the ground terminal 137, while the connecting portion 131 maintains a connection with the power feeding terminal 135. Here, the antenna pattern 103 operates as a monopole antenna.

Figure 9:
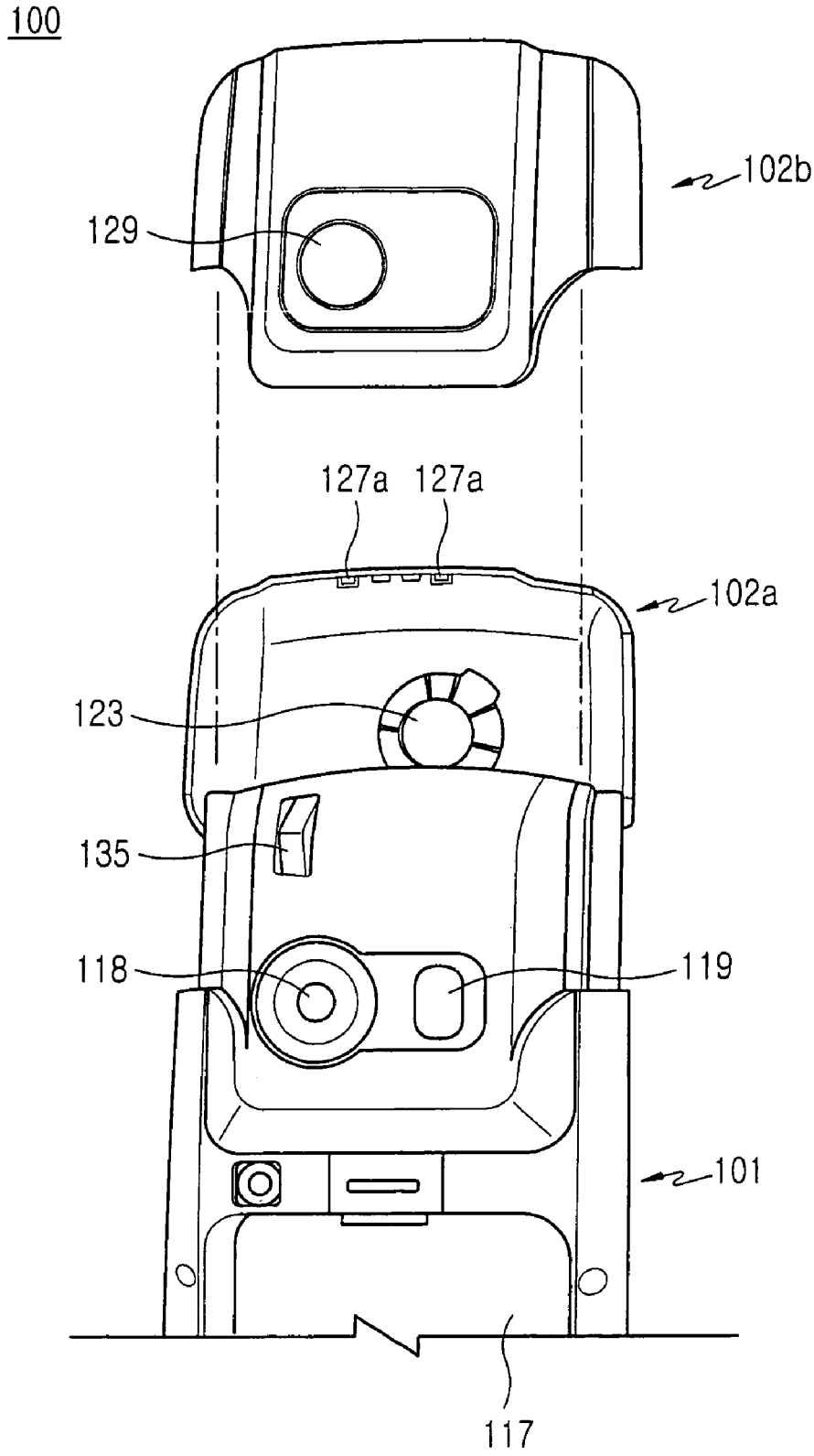
FIG. 9 is a partially exploded rear view illustration of a disassembled portable terminal in which a rear cover of a second housing of a portable terminal including an antenna device is separated from the portable terminal according to an alternative embodiment of the present invention.

FIG. 9 is a partially exploded rear view illustration of a disassembled portable terminal in which a rear cover of a second housing of a portable terminal including an antenna device is separated from the portable terminal according to an alternative embodiment of the present invention. Like reference numbers are used to refer to like elements through at the preceding drawings. The antenna device for the portable terminal 100 according to this embodiment of the present invention includes the power feeding terminal 135 and does not include the ground terminal 137 (which is included in other embodiments of the invention). In this embodiment, because the configuration of the antenna device for the portable terminal 100 has fewer parts, it is less expensive and easier to manufacture the portable terminal 100, contributing to a commensurate reduction in manufacturing costs. However, since the ground terminal 137 is not installed, the antenna pattern 103 also operates as a monopole antenna regardless of the position of the first housing 101. For example, when the second housing 102 overlaps with the first housing 101, the antenna pattern 103 operates as a monopole antenna.

As described above, in the antenna device according to a preferred embodiment of the present invention, which includes the power feeding terminal 135 and the ground terminal 137 for connecting the antenna pattern 103 with the circuit device, the antenna pattern 103 operates as a flat plate type inverted-F antenna or a loop antenna in the state where the second housing 102 overlaps with the first housing 101, and the antenna pattern 103 operates as a monopole antenna in the state where the second housing 102 is slidingly moved upward from the first housing 101. Also, in the antenna device according to another preferred embodiment of the present invention, in which the antenna pattern 103 operates as a monopole antenna regardless of the sliding movement of the second housing 102, it is easier to manufacture the portable terminal 100.

As described above, in the inventive antenna device for a portable terminal, by forming an antenna pattern on an inner surface of a second housing, which is assembled with a first housing so as to slidingly move on the first housing in a state of covering the first housing, and installing a power feeding terminal on the first housing, a configuration of the antenna device is simplified. Therefore, product manufacture is simplified and costs are reduced.

Also, when transmission/reception sensitivity decreases, excellent transmission/reception sensitivity can be secured by extending an antenna against the power feeding terminal by slidingly moving the second housing.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An antenna device for a portable terminal including a first housing and a second housing assembled with the first housing so as to be capable of slidingly moving relative to the first housing, the antenna device comprising:

an antenna pattern on an inner surface of the second housing; and at least one connecting terminal, protruding from an outer surface of the first housing and making sliding electrical contact with the antenna pattern, wherein the second housing covers at least a portion of the first housing, and wherein the at least one connecting terminal comprises:

a power feeding terminal, which protrudes from the outer surface of the first housing and slidingly contacts the antenna pattern; and a ground terminal, which protrudes from the outer surface of the first housing, and selectively contacts the antenna pattern according to the position of the second housing relative to the first housing.

2. The antenna device of claim 1, wherein the connecting terminal comprises a plate spring, which protrudes from the outer surface of the first housing and slidingly contacts the antenna pattern.

3. The antenna device of claim 2, wherein the connecting terminal continuously contacts the antenna pattern within a range of the sliding movement of the second housing.

4. The antenna device of claim 1, wherein the power feeding terminal continuously contacts the antenna pattern within a range of the sliding movement of the second housing.

5. The antenna device of claim 1, wherein the antenna pattern comprises:

a connecting portion, extending parallel to the direction of sliding movement of the second housing relative to the first housing and continuously contacts the connecting terminal; and a radiating portion, which is spaced apart from the power feeding terminal when the second housing is slidingly moved relative to the first housing.

6. The antenna device of claim 5, wherein, when the second housing overlaps with the first housing, the antenna pattern operates as a flat plate type inverted-F antenna when the radiating portion contacts the ground terminal.

7. The antenna device of claim 5, wherein, when the second housing overlaps with the first housing, the antenna pattern operates as a loop antenna when the radiating portion contacts the ground terminal.

8. The antenna device of claim 1, wherein, when the second housing is slidingly positioned relative to the first housing, the antenna pattern operates as a monopole antenna.

9. The antenna device of claim 1, wherein, the antenna pattern is printed on the inner surface of the second housing.

10. The antenna device of claim 1, wherein the antenna pattern is attached to the inner surface of the second housing and forms an antenna plate having a predetermined pattern shape constructed of sheet metal.

* * * * *